US005662273A

United States Patent [19]

Chih

[11] Patent Number: 5,662,273

[45] Date of Patent: Sep. 2, 1997

[54] SPRAYER GUN

[76] Inventor: I-Shun Chih, No. 5, Tyan Yang Lane, Lu Kang Chen, Chang Hua County, Taiwan

[21] Appl. No.: 561,837

[22] Filed: Nov. 27, 1995

[51] Int. Cl.[6] ..... B05B 9/01

[52] U.S. Cl. ..... 239/526

[58] Field of Search ..... 239/525, 526, 239/569, 578, 583

[56] References Cited

U.S. PATENT DOCUMENTS

| | | | |
|---|---|---|---|
| 2,362,946 | 11/1944 | Stockdale | 239/526 |
| 5,370,314 | 12/1994 | Gebauer et al. | 239/526 |

FOREIGN PATENT DOCUMENTS

| | | | |
|---|---|---|---|
| 404078458 | 3/1992 | Japan | 239/526 |
| 6-277565 | 10/1994 | Japan | 239/526 |

*Primary Examiner*—Andres Kashnikow
*Assistant Examiner*—Robin O. Evans
*Attorney, Agent, or Firm*—Charles E. Baxley, Esq.

[57] ABSTRACT

A sprayer gun includes gun body and a handle secured together. The handle includes a valve seat formed in a pathway and a valve slidably engaged in the pathway for engaging with the valve seat so as to block the pathway. An arm is pivotally coupled to the handle and has one end for engaging with the valve. A hook is secured to the handle. A hand grip is pivotally coupled to the handle for engaging with the arm so as to disengage the valve from the valve seat. A knob is slidably engaged in the hand grip. A lever is pivotally coupled to the hand grip and has one end for engaging with the hook so as to secure the hand grip to the handle and has the other end for engaging with the knob. The one end of the lever is disengaged from the hook when the other end of the lever is moved inward of the hand grip by the knob.

1 Claim, 4 Drawing Sheets

SPRAYER GUN

BACKGROUND OF THE INVENTION

1. Field of the Invention

The present invention relates to a sprayer gun and more particularly to a sprayer gun having a hand grip retaining mechanism.

2. Description of the Prior Art

Typical sprayer guns comprise a gun body having a handle secured thereto and having a hand grip pivotally coupled to the handle for actuating a valve which is engaged in the handle. The valve may control the water flow of the sprayer gun. However, the users have to continuously force the hand grip inward of the handle so as to allow the water to flow out of the sprayer gun. Once the hand grip is released, the water is blocked and is prevented from flowing out of the sprayer gun. One type of retaining device has been developed to retain with the hand grip to the handle when the hand grip is pulled toward the handle in order to allow the water to flow out of the sprayer gun continuously. However, the retaining device includes a complicated configuration.

The present invention has arisen to mitigate and/or obviate the afore-described disadvantages of the conventional sprayer guns.

SUMMARY OF THE INVENTION

The primary objective of the present invention is to provide a sprayer gun which includes a hand grip retaining mechanism for retaining the hand grip in an active position so as to allow the water to flow out of the sprayer gun without operating the hand grip.

In accordance with one aspect of the invention, there is provided a sprayer gun comprising a gun body including a bore formed therein and including a handle secured thereto, the handle including a pathway formed therein and including a valve seat formed in the pathway, a valve means slidably engaged in the pathway for engaging with the valve seat so as to block the pathway, an arm including a middle portion pivotally coupled to the handle and including a first end for engaging with the valve means and including a second end, a hook means secured to the handle, a hand grip pivotally coupled to the handle for engaging with the second end of the arm and for disengaging the valve means from the valve seat when the hand grip is pulled toward the handle, a knob slidably engaged in the hand grip, a lever including a middle portion pivotally coupled to the hand grip and including a first end for engaging with the hook means so as to secure the hand grip to the handle, and including a second end for engaging with the knob, and means for biasing the second end of the lever to engage with the knob and for biasing the first end of the lever to engage with the hook means. The first end of the lever is disengaged from the hook means when the second end of the lever is moved against the biasing means by the knob.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
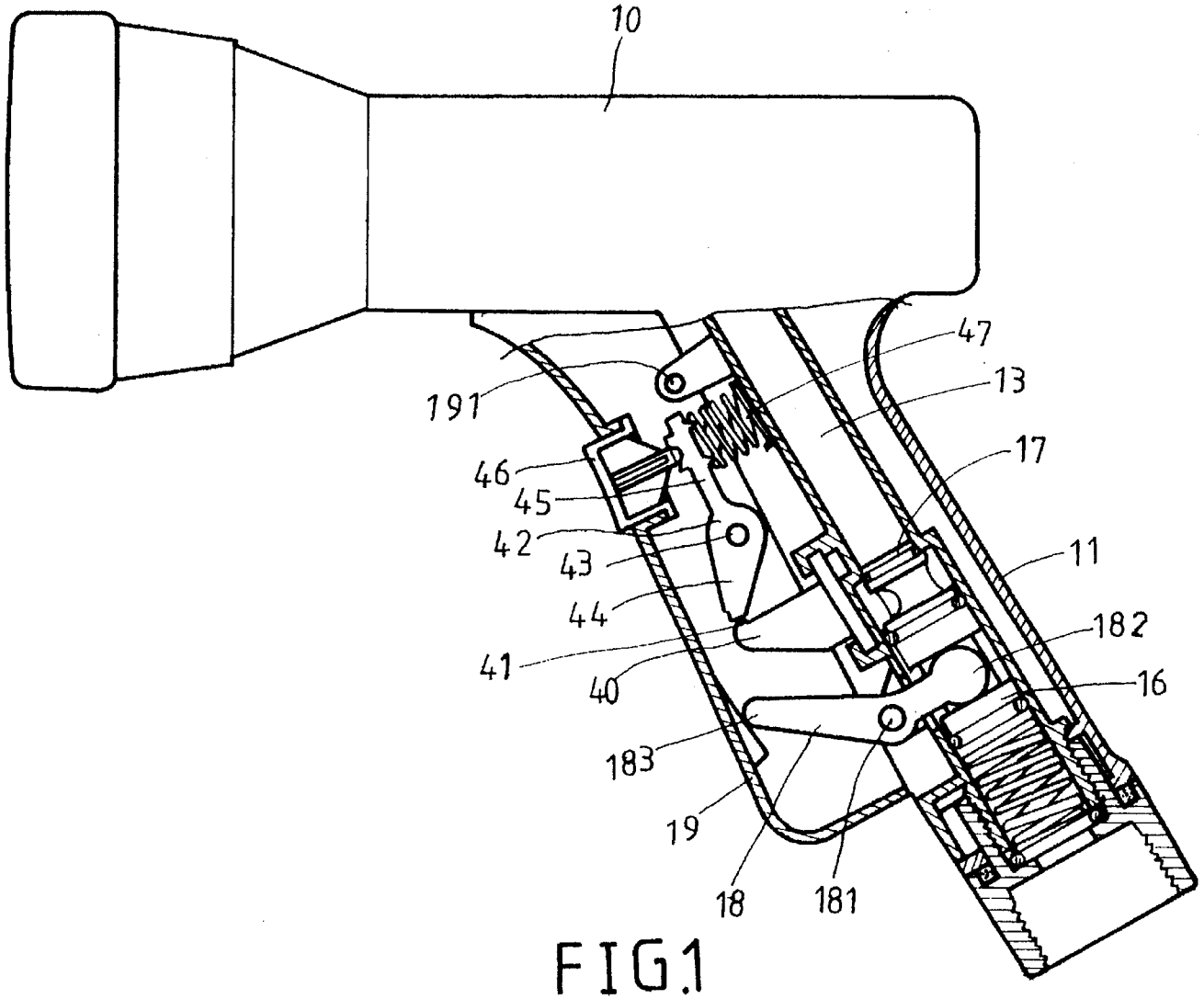
FIG. 1 is a cross sectional view of a sprayer gun in accordance with the present invention.

Referring to FIG. 1, a sprayer gun comprises a gun body 10 and a handle 11 secured to the gun body 10. The the handle 11 includes a pathway 13 for communicating with the gun body 10. A valve 16 is slidably engaged in the pathway 13 for engaging with a valve seat 17 so as to block the pathway 13 and so as to control the water flowing through the pathway 13. An arm 18 has a middle portion pivotally coupled to the handle 11 at a pivot axle 181 and has one end 182 engaged with the valve 16 for disengaging the valve 16 from the valve seat 17. A hand grip 19 is pivotally coupled to the handle 11 at a pivot shaft 191 and is engaged with the other end 183 of the arm 18 so as to rotate the arm 18 and so as to move the valve 16 away from the valve seat 17 and in order to allow the water to flow through the pathway 13. The above described configuration is conventional and will not be described in further details.

Figure 2:
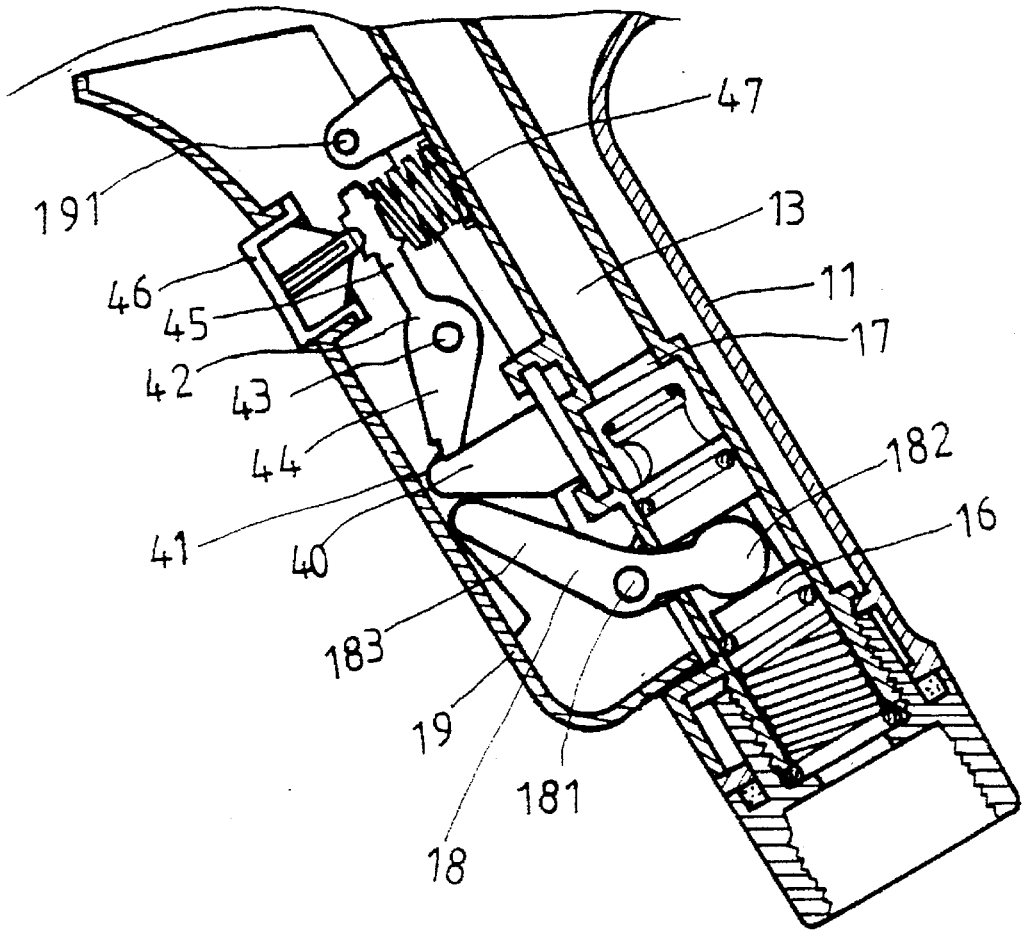
FIGS. 2 and 3 are partial cross sectional views illustrating the operation of the sprayer gun.

Referring next to FIG. 2 and again to FIG. 1, a bar 40 is secured to the handle 11 and includes a hook 41 formed in the free end portion and located close to the hand grip 19. A lever 42 has a middle portion pivotally coupled to the hand grip 19 at a pivot pin 43 and includes one end 44 for engaging with the hook 41 and includes the other end 45 for engaging with a spring 47 and a knob 46. The knob 46 is slidably engaged in the hand grip 19 for engaging with and for moving the other end 45 of the lever 42 against the spring 47 so as to disengage the end 44 of the lever 42 from the hook 41. The spring 47 may bias the other end 45 of the lever toward the knob 46 so as to bias the knob 46 outward of the hand grip 19, and so as to allow the end 44 of the lever 42 to engage with the hook 41.

Figure 3:
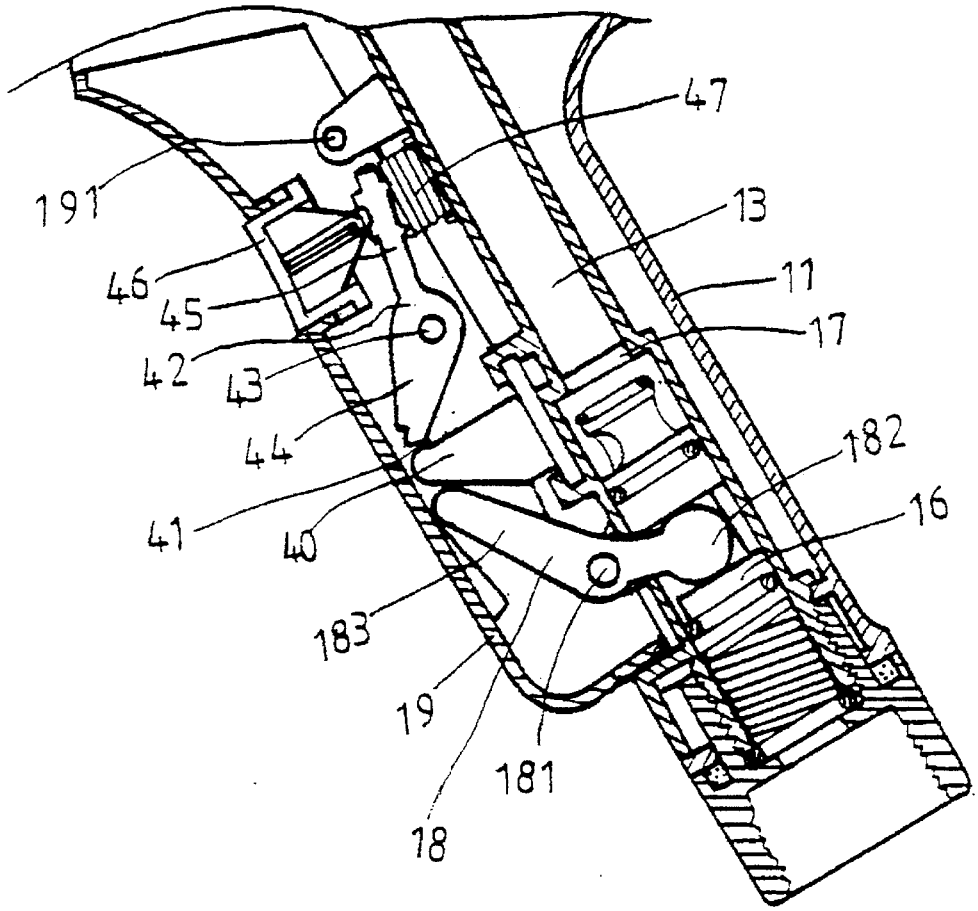

In operation, as shown in FIG. 3, when the hand grip 19 is pulled toward the handle 11, the lever 42 may be moved toward the handle 11 until the end 44 of the lever 42 is engaged with the hook 41. At this moment, the valve 16 is disengaged from the valve seat 17 by the arm 18 such that the water may flow through the pathway 13, and the hand grip 19 is secured to the handle 11 by the lever 42 such that the valve 16 may be disengaged from the valve seat 17 without continuously pulling the hand grip 19; i.e., at this time, the user may release the hand grip 19.

When it is required to block the pathway 13 in order to prevent the water from flowing out of the sprayer gun, it is only required to depress the knob 46 inward of the hand grip 19, best shown in FIG. 3. The end 44 of the lever 42 may be disengaged from the hook 41 when the other end 45 of the lever 42 is moved against the spring 47 by the knob 46.

Figure 4:
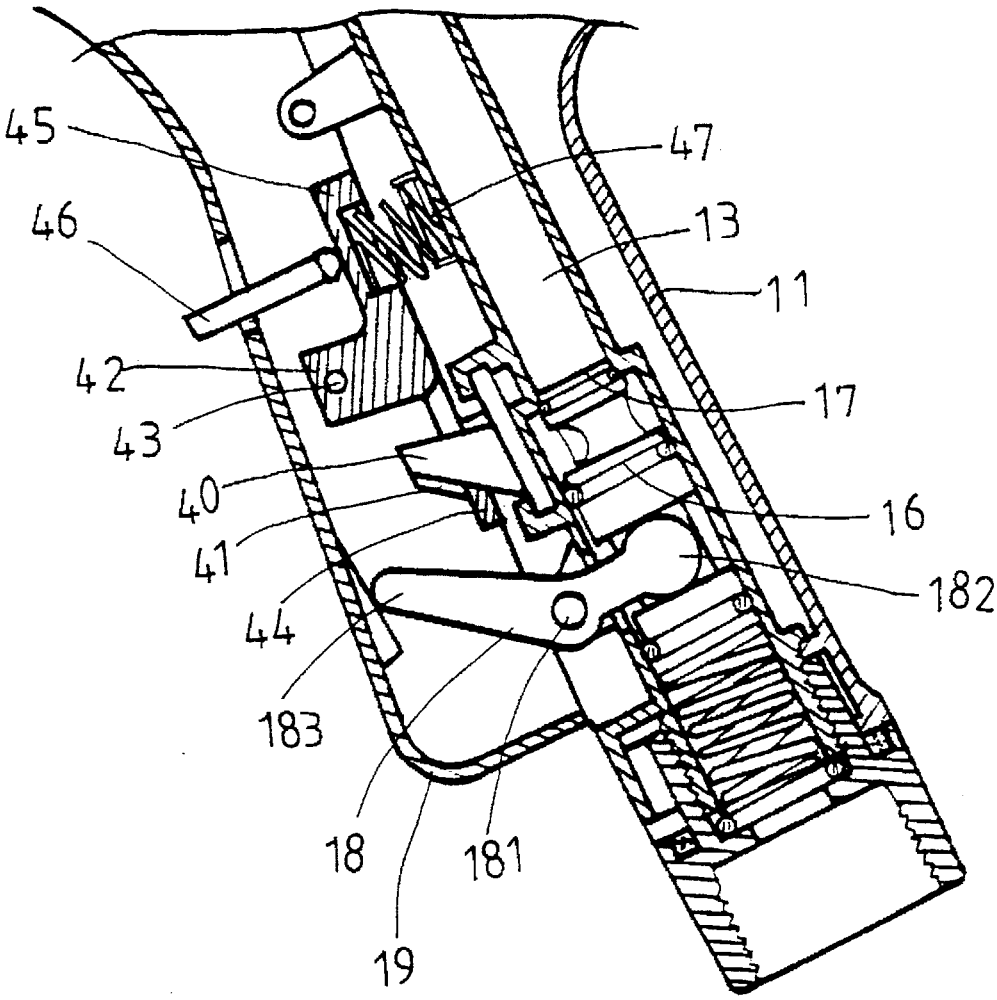
FIG. 4 is a cross sectional view similar to FIGS. 2 and 3, illustrating another application of the sprayer gun.

Referring next to FIG. 4, alternatively, the hook 41 may engage through the one end 44 of the lever 42 for engaging with the one end 44 of the lever 42 and for retaining the hand grip 19 to the handle 11.

Accordingly, the sprayer gun in accordance with the present invention includes a retaining mechanism for retaining the hand grip in an active position so as to allow the water to flow out of the sprayer gun without operating the hand grip.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sprayer gun comprising:

a gun body including a bore and including a handle secured thereto, said handle including a pathway and including a valve seat formed in said pathway, a valve means slidably engaged in said pathway for engaging with said valve seat so as to block said pathway, an arm including a middle portion pivotally coupled to said handle and including a first end for engaging with said valve means and including a second end, a hook means secured to said handle, a hand grip pivotally coupled to said handle for engaging with said second end of said arm and for disengaging said valve means from said valve seat when said hand grip is pulled toward said handle, a knob slidably engaged in said hand grip, a lever including a middle portion pivotally coupled to said hand grip and including a first end for engaging with said hook means so as to secure said hand grip to said handle, and including a second end for engaging with said knob, and means for biasing said second end of said lever to engage with said knob and for biasing said first end of said lever to engage with said hook means, said first end of said lever being disengaged from said hook means when said second end of said lever is moved against said biasing means by said knob.

* * * * *